US006389815B1

(12) United States Patent
Hura et al.

(10) Patent No.: US 6,389,815 B1
(45) Date of Patent: May 21, 2002

(54) FUEL NOZZLE ASSEMBLY FOR REDUCED EXHAUST EMISSIONS

(75) Inventors: Harjit Singh Hura; Paul Edward Sabla, both of Cincinnati; James Neil Cooper, Hamilton; Beverly Stephenson Duncan; Hukam Chand Mongia, both of West Chester; Steven Joseph Lohmueller, Reading, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/658,872

(22) Filed: Sep. 8, 2000

(51) Int. Cl.[7] ..... F02C 7/22
(52) U.S. Cl. ..... 60/746; 60/748
(58) Field of Search ..... 60/746, 748

(56) References Cited

U.S. PATENT DOCUMENTS

| | | | | | |
|---|---|---|---|---|---|
| 2,850,875 | A | * | 9/1958 | Gahwyler | 60/746 |
| 3,938,324 | A | * | 2/1976 | Hammond et al. | 60/746 |
| 4,180,974 | A | | 1/1980 | Stenger et al. | 60/39.71 |
| 4,389,848 | A | * | 6/1983 | Markowski et al. | 60/746 |
| 4,733,538 | A | | 3/1988 | Vdoviak et al. | 60/752 |
| 4,916,906 | A | | 4/1990 | Vogt | 60/754 |
| 5,154,060 | A | | 10/1992 | Walker et al. | 60/746 |
| 5,233,828 | A | | 8/1993 | Napoli | 60/261 |
| 5,241,827 | A | | 9/1993 | Lampes | 60/754 |
| 5,261,223 | A | | 11/1993 | Foltz | 60/39.36 |
| 5,265,425 | A | | 11/1993 | Howell | 60/736 |
| 5,279,127 | A | | 1/1994 | Napoli | 60/754 |
| 5,307,637 | A | | 5/1994 | Stickles et al. | 60/756 |
| 5,323,604 | A | | 6/1994 | Ekstedt et al. | 60/39.36 |
| 5,325,660 | A | * | 7/1994 | Taniguchi et al. | 60/746 |
| 5,329,761 | A | | 7/1994 | Ablett et al. | 60/39.36 |
| 5,540,056 | A | | 7/1996 | Heberling et al. | 60/737 |
| 5,899,074 | A | * | 5/1999 | Komatsu et al. | 60/746 |
| 5,970,716 | A | | 10/1999 | Forrester et al. | 60/746 |
| 6,021,635 | A | | 2/2000 | Gaag et al. | 60/39.05 |
| 6,038,861 | A | * | 3/2000 | Amos et al. | 60/746 |
| 6,076,356 | A | | 6/2000 | Pelletier | 60/740 |

* cited by examiner

*Primary Examiner*—Michael Koczo
(74) *Attorney, Agent, or Firm*—William Scott Andes; Alfred J. Mangels

(57) ABSTRACT

A two-stage fuel nozzle assembly for a gas turbine engine. The primary combustion region is centrally positioned and includes a fuel injector that is surrounded by one or more swirl chambers to provide a fuel air mixture that is ignited to define a first stage combustion zone. A secondary combustion region is provided by an annular housing that surrounds the primary combustion region, and it includes a secondary fuel injector having a radially outwardly directed opening and surrounded by an annular ring that includes openings for providing a swirl chamber for the secondary combustion region. Cooling air is directed angularly between the primary and secondary combustion zones to delay intermixing and thereby allow more complete combustion of the respective zones prior to their coalescing further downstream. The primary combustion region is activated during idle and low engine power conditions and both the primary and secondary combustion regions are activated during high engine power conditions.

19 Claims, 6 Drawing Sheets

FUEL NOZZLE ASSEMBLY FOR REDUCED EXHAUST EMISSIONS

BACKGROUND OF THE INVENTION

The present invention relates to gas turbine engine combustion systems, and more particularly to a staged combustion system in which the production of undesirable combustion product components is minimized over the engine operating regime.

Modem day emphasis on minimizing the production and discharge of gases that contribute to smog and to other undesirable environmental conditions, particularly those gases that are emitted from internal combustion engines, have led to different gas turbine engine combustor designs that have been developed in an effort to reduce the production and discharge of such undesirable combustion product components. Other factors that influence combustor design are the desires of users of gas turbine engines for efficient, low cost operation, which translates into a need for reduced fuel consumption while at the same time maintaining or even increasing engine output. As a consequence, important design criteria for aircraft gas turbine engine combustion systems include provision for high combustion temperatures, in order to provide high thermal efficiency under a variety of engine operating conditions, as well as the minimization of undesirable combustion conditions that contribute to the emission of particulates, to the emission of undesirable gases, and to the emission of combustion products that are ,precursors to the formation of photochemical smog.

Various governmental regulatory bodies have established emission limits for acceptable levels of unburned hydrocarbons (HC), carbon monoxide (CO), and oxides of nitrogen ($NO_x$), which have been identified as the primary contributors to the generation of undesirable atmospheric conditions. And different combustor designs have been developed to meet those criteria. For example, one way in which the problem of minimizing the emission of undesirable gas turbine engine combustion products has been attacked is the provision of staged combustion. In that arrangement, a combustor is provided in which a first stage burner is utilized for low speed and low power conditions, to more closely control the character of the combustion products, and a combination of first stage and second stage burners is provided for higher power outlet conditions while attempting to maintain the combustion products within the emissions limits. However, balancing the operation of the first and second stage burners to allow efficient thermal operation of the engine, on the one hand, while on the other hand simultaneously minimizing the production of undesirable combustion products is difficult to achieve. In that regard, operating at low combustion temperatures to lower the emissions of $NO_x$, also can result in incomplete or partially incomplete combustion, which can lead to the production of excessive amounts of HC and CO, in addition to producing lower power output and lower thermal efficiency. High combustion temperature, on the other hand, although improving thermal efficiency and lowering the amount of HC and CO, often result in a higher output of $NO_x$.

Another way that has been proposed to minimize the production of those undesirable combustion product components is to provide for more effective intermixing of the injected fuel and the combustion air. In that regard, numerous mixer designs have been proposed over the years to improve the mixing of the fuel and air so that burning will occur uniformly over the entire mixture, to reduce the level of HC and CO that result from incomplete combustion. On the other hand, even with improved mixing, under high power conditions, when the flame temperatures are high, higher levels of undesirable $NO_x$ are formed.

Thus, there is a need to provide a gas turbine engine combustor in which the production of undesirable combustion product components is minimized over a wide range of engine operating conditions.

BRIEF SUMMARY OF THE INVENTION

It is therefore desirable to provide a gas turbine engine combustion system in which staged combustion can occur, to respond to particular power output demands, and also one in which the emission of undesirable combustion product components is minimized over a broad range of engine operating conditions.

Briefly stated, in accordance with one aspect of the present invention, a fuel nozzle assembly is provided for use in a gas turbine engine. The fuel nozzle assembly includes a primary fuel injector having a central axis, and the primary fuel injector is disposed for injecting a primary fuel spray into a primary air stream. A secondary fuel injector is positioned radially outwardly of the primary fuel injector for injecting a secondary fuel spray into a secondary air stream that is spaced radially outwardly of and that surrounds the primary air stream. At least one air jet is positioned between the primary fuel injector and the secondary fuel injector and is inclined relative to the primary fuel injector central axis to direct a portion of an incoming air stream between the primary air stream and the secondary air stream in an angular downstream direction relative to the primary air stream.

BRIEF DESCRIPTION OF THE DRAWINGS

The structure, operation, and advantages of the present invention will become further apparent upon consideration of the following description, taken in conjunction with the accompanying drawings in which.

DETAILED DESCRIPTION OF THE INVENTION

Figure 1:
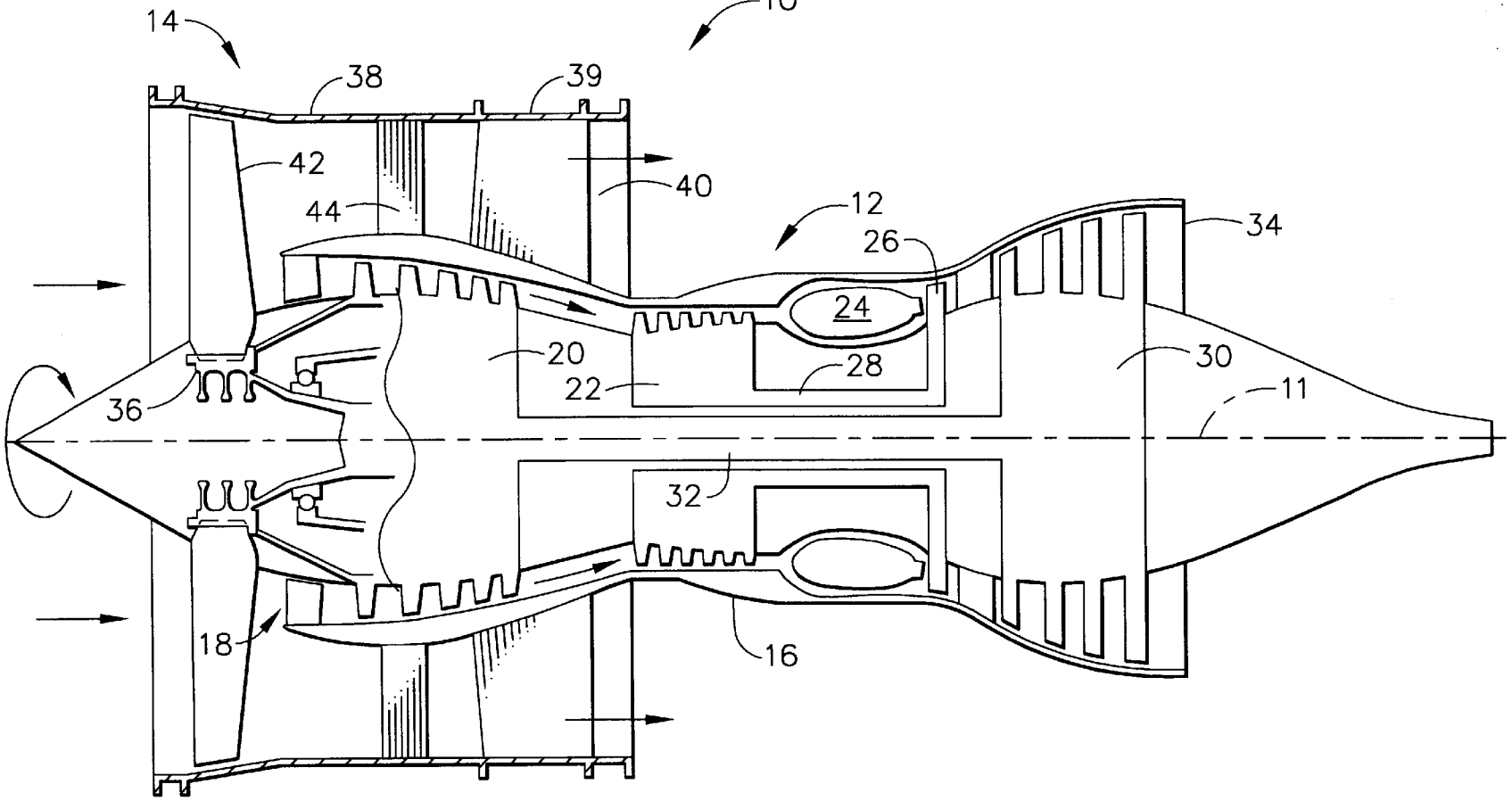
FIG. 1 is a longitudinal, cross-sectional view of an aircraft gas turbine engine including a fan stage and showing the arrangement of the several major components thereof.

Referring now to the drawings, and particularly to FIG. 1 thereof, there is shown in diagrammatic form an aircraft turbofan engine 10 having a longitudinal axis 11 and that includes a core gas turbine engine 12 and a fan section 14 positioned upstream of the core engine. Core engine 12 includes a generally tubular outer casing 16 that defines an annular core engine inlet 18 and that encloses and supports a pressure booster 20 for raising the pressure of the air that enters core engine 12 to a first pressure level. A high pressure, multi-stage, axial-flow compressor 22 receives pressurized air from booster 20 and further increases the pressure of the air. The pressurized air flows to a combustor 24 in which fuel is injected into the pressurized air stream to raise the temperature and energy level of the pressurized air. The high energy combustion products flow to a first turbine 26 for driving compressor 22 through a first drive shaft 28, and then to a second turbine 30 for driving booster 20 through a second drive shaft 32 that is coaxial with first drive shaft 28. After driving each of turbines 26 and 30, the combustion products leave core engine 12 through an exhaust nozzle 34 to provide propulsive jet thrust.

Fan section 14 includes a rotatable, axial-flow fan rotor 36 that is surrounded by an annular fan casing 38. The fan casing is supported from core engine 12 by a plurality of substantially radially-extending, circumferentially-spaced support struts 40. Fan casing 38 encloses fan rotor 36 and fan rotor blades 42 and is supported by radially-extending outlet guide vanes 44. Downstream section 39 of fan casing 38 extends over an outer portion of core engine 12 to define a secondary, or bypass, airflow conduit that provides additional propulsive jet thrust.

Figure 2:
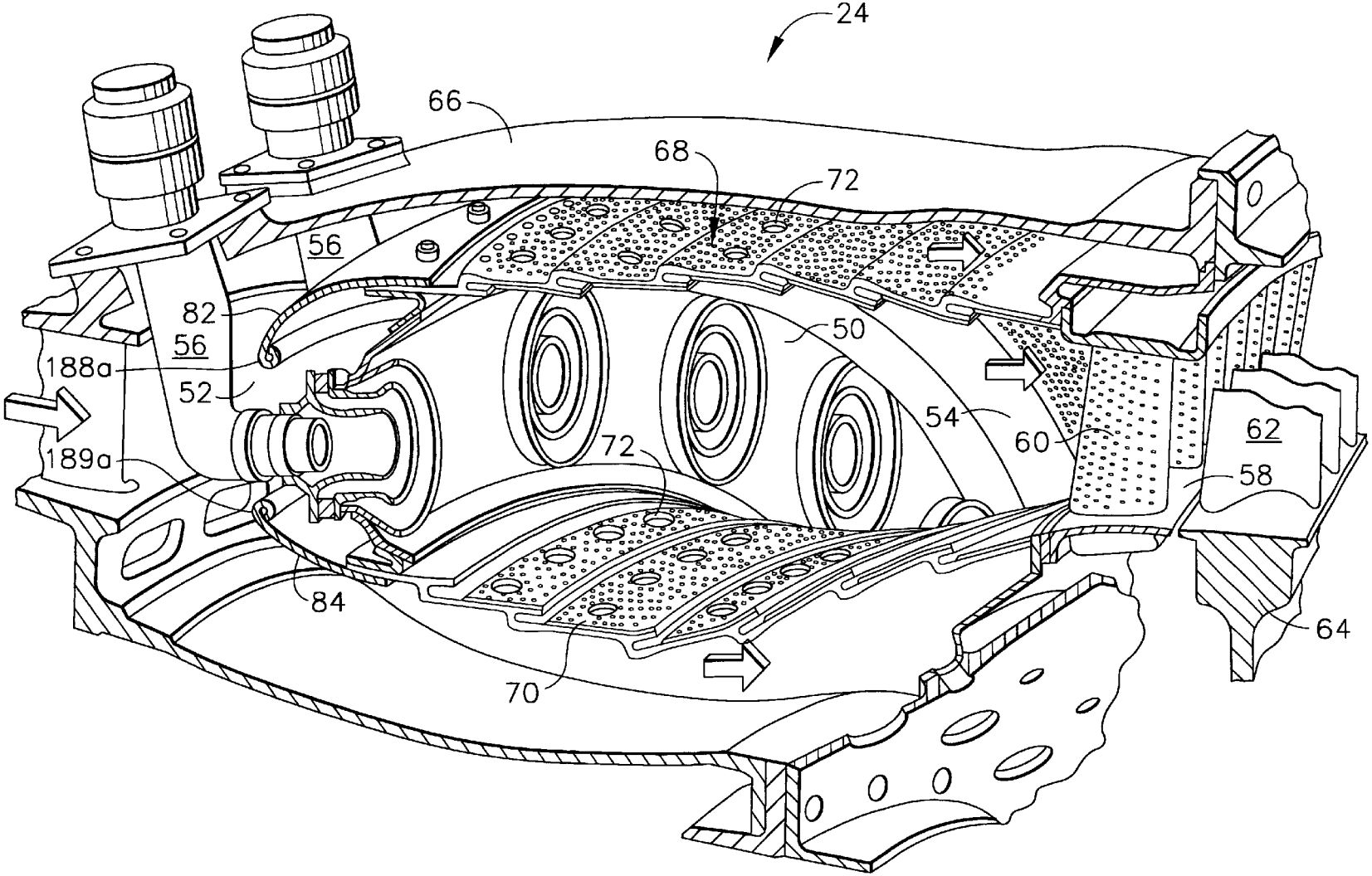
FIG. 2 is a fragmentary perspective view, partially broken away, showing one form of annular gas turbine engine combustor.

One form of combustor 24 for a gas turbine engine is shown in FIG. 2. The arrangement shown is an annular combustion chamber 50 that is coaxial with engine longitudinal axis 11 and that includes an inlet 52 and an outlet 54. Combustor 24 receives an annular stream of pressurized air from the compressor discharge outlet (not shown). A portion of the compressor discharge air flows into combustion chamber 50, into which fuel is injected from a fuel injector 56 to mix with the air and form a fuel-air mixture for combustion. Ignition of the fuel-air mixture is accomplished by a suitable igniter (not shown), and the resulting combustion gasses flow in an axial direction toward and into an annular, first stage turbine nozzle 58. Nozzle 58 is defined by an annular flow channel that includes a plurality of radially-extending, circularly-spaced nozzle vanes 60 that turn the gases so that they flow angularly and impinge upon a plurality of radially-extending first stage turbine blades 62 that are carried by a first stage turbine disk 64. As shown in FIG. 1, first stage turbine 26 rotates compressor 22, and one or more additional downstream stages 30 can be provided for driving booster 22 and fan rotor 36.

Combustion chamber 50 is housed within engine outer casing 66 and is defined by an annular combustor outer liner 68 and a radially-inwardly positioned annular combustor inner liner 70. The arrows in FIG. 2 show that directions in which compressor discharge air flows within combustor 24. As shown, part of the air flows over the outermost surface of outer liner 68, part flows into combustion chamber 50, and part flows over the innermost surface of inner liner 70.

Each of outer and inner liners 68, 70, respectively, can be provided with a plurality of dilution openings 72 to allow additional air to enter the combustor for completion of the combustion process before the combustion products enter turbine nozzle 58. Additionally, outer and inner liners 68, 70, respectively, can also be provided in a stepped form, as shown, to include a plurality of annular step portions 74 that are defined by relatively short, inclined, outwardly-flaring annular panels 76 that include a plurality of smaller, circularly-spaced cooling air apertures 78 for allowing some of the air that flows along the outermost surfaces of outer and inner liners 68, 70, respectively, to flow into the interior of combustion chamber 50. Those inwardly-directed air flows pass along the inner surfaces of outer and inner liners, 68, 70, respectively, those surfaces that face the interior of combustion chamber 50, to provide a film of cooling air along the inwardly-facing surfaces of each of the inner and outer liners at respective intermediate annular panels 80.

As shown in FIG. 2, a plurality of axially-extending fuel nozzle assemblies 56 are disposed in a circular array at the upstream end of combustor 24 and extend into inlet 52 of annular combustion chamber 50. The upstream portions of each of inner and outer liners 68, 70, respectively, are spaced from each other in a radial direction and define an outer cowl 82 and an inner cowl 84, the spacing between the forward-most ends of which defines combustion chamber inlet 52 to provide an opening to allow compressor discharge air to enter combustion chamber 50. The fuel nozzle assemblies hereinafter described can be disposed in a combustor in a manner similar to the disposition of fuel injectors 56 shown in FIG. 2.

Figure 3:
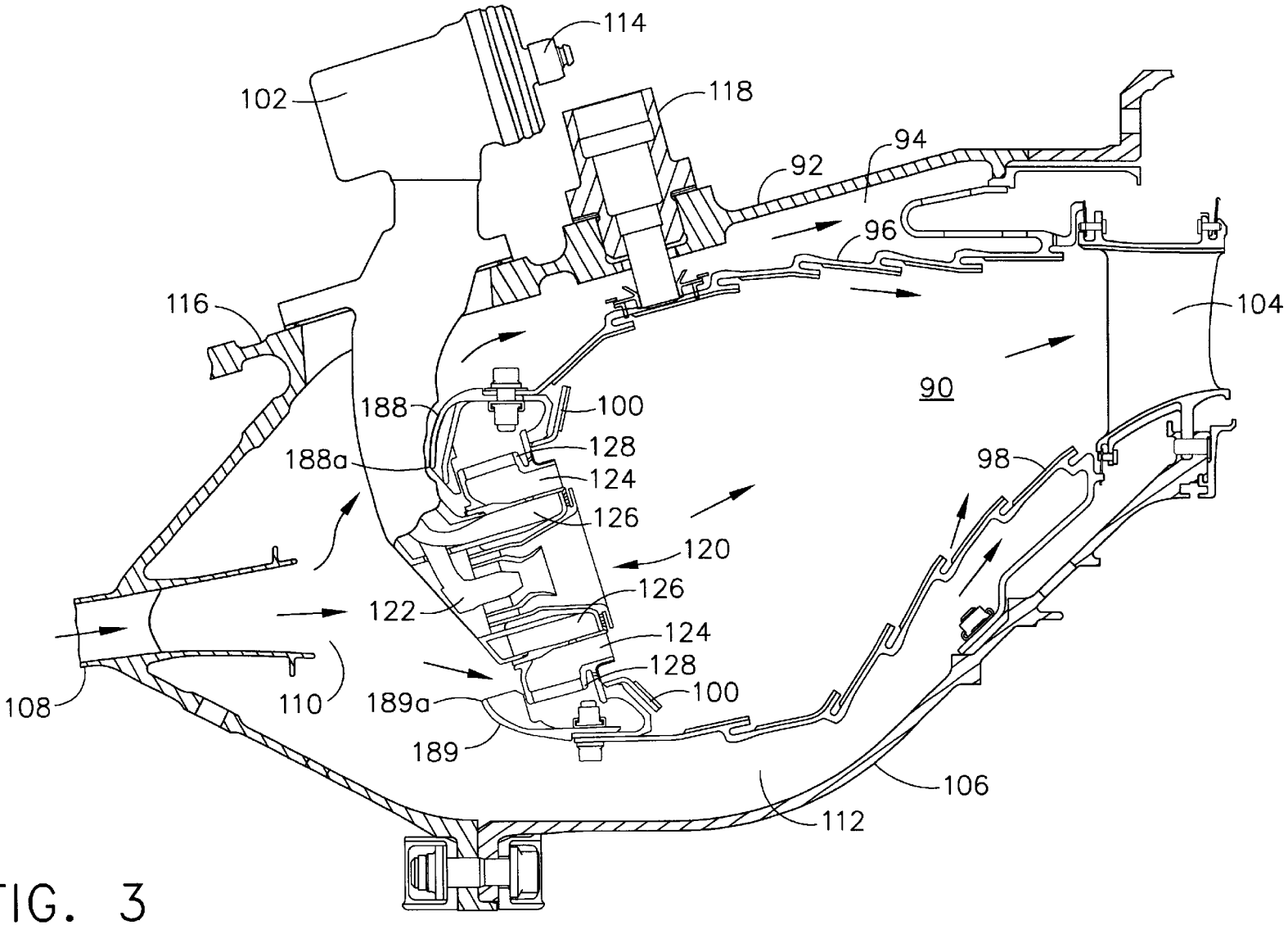
FIG. 3 is a longitudinal, cross-sectional view of a gas turbine engine combustor that includes a fuel nozzle assembly in accordance with one embodiment of the present invention for providing staged combustion in a primary combustion region and in a surrounding secondary combustion region.

A combustion chamber having a fuel nozzle assembly in accordance with one embodiment of the present invention is shown in FIG. 3. Annular combustion chamber 90 is contained within an annular engine outer casing 92 and is spaced inwardly therefrom to define an outer wall of an outer flow channel 94 for compressor discharge air to pass therethrough for cooling purposes. Combustion chamber 90 includes an annular combustor outer liner 96 and an annular combustor inner liner 98, and it extends axially downstream for a predetermined distance. The upstream end of combustion chamber 90 includes an annular dome 100 with suitable air entry holes to admit compressor discharge air, and that extends inwardly and forwardly to a fuel nozzle assembly 102. The cross-sectional area of combustion chamber 90 diminishes in a downstream direction to correspond at its downstream end with the cross sectional area of first stage turbine nozzle 104 into which the combustion products pass.

An annular inner casing 106 is provided radially inwardly of inner liner 98 to confine air from the compressor discharge to pass along the outer surface of combustor inner liner 98 and also to shield other engine internal components, such as the engine drive shaft (not shown), from the heat generated within combustion chamber 90.

In the embodiment as shown, compressor discharge air flows to combustion chamber 90 through an annular duct 108 that discharges into an enlarged cross-sectional area diff-user section 110 immediately upstream of combustion chamber 90. Diffuser section 110 is in communication with outer flow channel 94, with an inner flow channel 112, and with fuel nozzle assembly 102. A major portion of the compressor discharge air enters combustion chamber 90 through and around fuel nozzle assembly 102 while the remaining compressor discharge air flows upwardly through outer flow channel 94 and downwardly through inner flow channel 112 around combustion chamber 90 for cooling purposes.

Fuel nozzle assembly 102 is in communication with a source of pressurized fuel (not shown) through a fuel inlet 114. Nozzle assembly 102 is suitably carried by engine outer casing 116 and is rigidly connected thereto, such as by bolts or the like. An igniter 118 is positioned downstream of the fuel nozzle holder and extends through outer casing 116 and into combustion chamber 90 to provide initial ignition of the fuel-air mixture within the combustion chamber. Fuel nozzle assembly 102 provides a central, primary combustion region 120 into which fuel is injected from a primary fuel injector 122, and an annular, secondary combustion region 124 into which fuel is injected from an annular, secondary fuel injector 126 that is radially outwardly spaced from and that surrounds primary fuel injector 122.

Depending upon the size of the engine, as many as twenty or so fuel nozzle assemblies can be disposed in a circular array at the inlet of the combustion chamber. Fuel injectors 122, 126 of each fuel nozzle assembly 102 are received in a respective annular combustor dome 100 that extends forwardly from and is connected with the forwardmost ends of each of outer liner 96 and inner liner 98.

An outer cowl 188 extends forwardly from the forwardmost edge of outer liner 96. Outer cowl 188 is curved inwardly toward fuel injector 122 and terminates at an outer cowl lip 188*a*. Similarly, an inner cowl 189 extends forwardly from the forwardmost edge of inner liner 98 and is also curved inwardly toward fuel injector 122. Inner cowl 189 terminates at an inner cowl lip 189*a*. Each of outer cowl lip 188*a* and inner cowl lip 189*a* are spaced from each other in a radial direction, relative to the engine longitudinal axis, to define an annular opening through which compressor discharge air can pass to enter combustion chamber 90.

Figure 4:
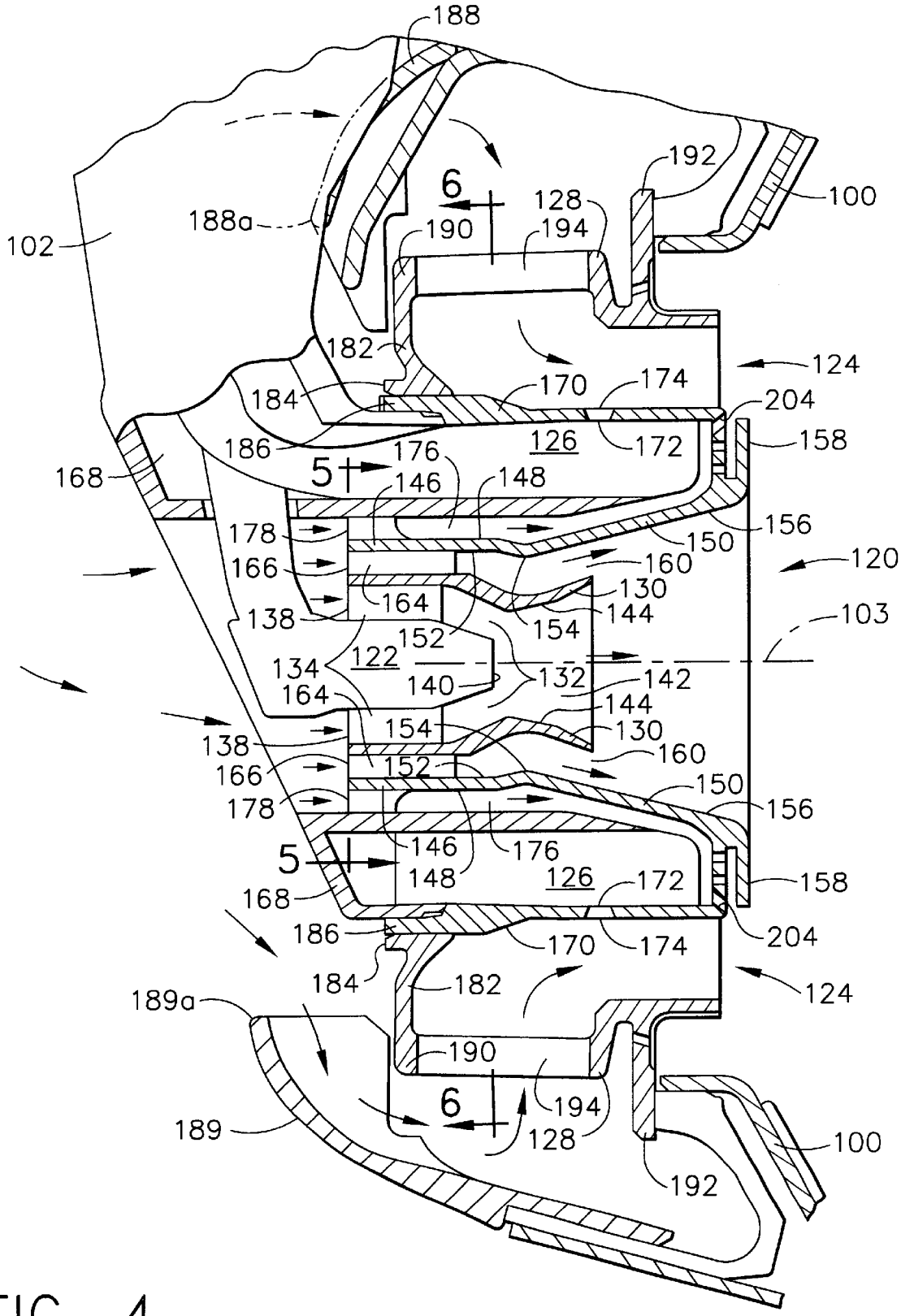
FIG. 4 is an enlarged, cross-sectional view of the fuel nozzle assembly shown in FIG. 3.
Figure 4A:
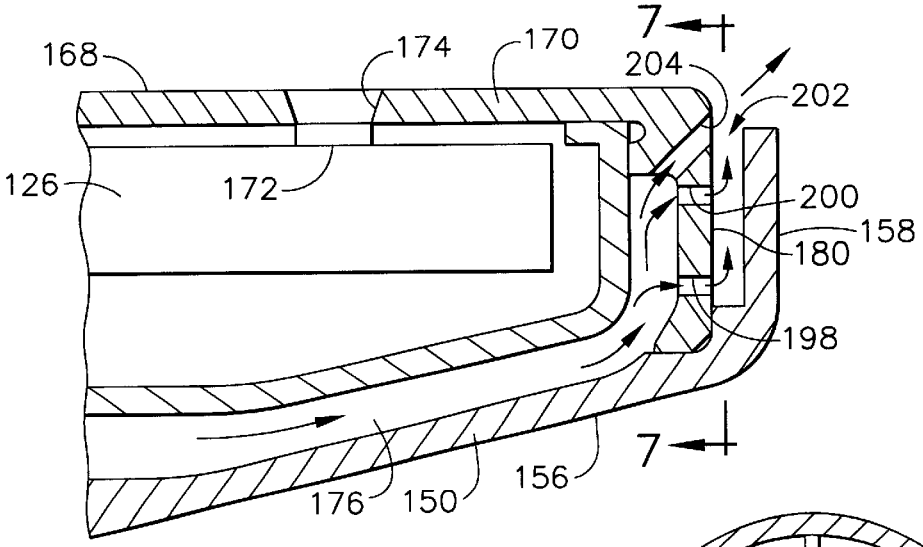
FIG. 4*a* is an enlarged, fragmentary, cross-sectional view of the downstream end of an annular housing containing secondary fuel injectors and showing cooling air apertures in one embodiment of the present invention.

FIGS. 4 and 4*a* show the fuel nozzle assembly of FIG. 3 in greater detail. As shown in FIG. 4, the fuel outlet end of fuel nozzle assembly 102 that is received within combustor dome 100 is generally axisymmetric and includes a central, primary combustion region 120 and a surrounding, annular, secondary combustion region 124. Primary combustion region 120 includes primary fuel injector 122 that is surrounded by a concentric, primary annular member 130 to define therebetween an inner annular air passageway 132. Annular housing 130 is radially outwardly spaced from primary fuel injector 122 and is connected therewith by a plurality of radially-extending inner swirl vanes 134. Swirl vanes 136 are inclined both radially and axially relative to axis 103 of fuel nozzle assembly 102, to impart a rotational component of motion to the incoming compressor discharge air that enters through inlet 138, to cause the air to swirl in a generally helical manner within annular passageway 132. Annular member 130 is so configured as to surround primary fuel injector 122 and to provide an inner, substantially constant cross-sectional area, annular flow channel around the outer surface of primary fuel injector 122, and to provide downstream of injector face 140 a first diffuser section 142 by way of an outwardly-flaring wall 144.

A second annular member 146 surrounds and is spaced radially outwardly of primary annular member 130. Second annular member 146 includes an outer wall 148 and an inner wall 150, wherein inner wall 150 includes first axially extending surface 152, a reduced diameter intermediate section 154, and an outwardly-diverging outer section 156 that terminates in a radially outwardly extending flange 158. Inner wall 150 defines with primary annular member 130 an outer annular air passageway 160.

Second annular member 146 is connected with primary annular member 130 by a plurality of radially-extending outer swirl vanes 164. As was the case with inner swirl vanes 134, outer swirl vanes 164 are also inclined both radially and axially relative to fuel nozzle assembly axis 103 to impart a rotational component of motion to compressor discharge air that enters outer passageway 160 at inlet 166, and to cause the air to swirl in a generally helical manner as it passes through passageway 160. The direction of rotation of the air stream within passageway 160 can be the same as the direction of rotation of the air stream within passageway 132. If desired, however, the directions of rotation of the respective air streams can be in opposite directions, the directions of rotation depending upon the fuel nozzle assembly size and configuration, as well as the operating conditions within a particular combustion chamber design.

Figure 5:
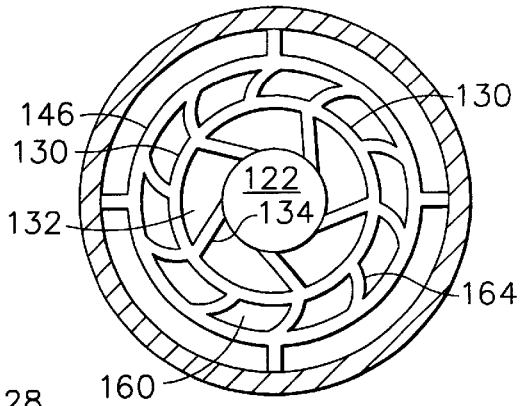
FIG. 5 is a cross-sectional view taken along the line 5—5 of FIG. 4 and showing the primary fuel injector and surrounding swirl vanes.

Air passageways 132 and 160, as well as the arrangement of inner swirl vanes 134 and outer swirl vanes 164, are shown in the cross-sectional view provided in FIG. 5. As there shown, the respective swirl vanes are so disposed as to impart rotation to the respective flow streams that pass therethrough, but in opposite rotational directions relative to fuel nozzle assembly axis 103.

Second annular member 146 also defines an inner wall of an annular housing 168 that includes an outer annular wall 170. Housing 168 encloses secondary fuel injector 126 that includes a plurality of radially-outwardly-directed circumferential openings 172 that are positioned opposite from respective larger diameter radial openings 174 provided in outer wall 170. Openings 172 allow fuel to issue through respective openings 174 into secondary combustion region 124.

Figure 6:
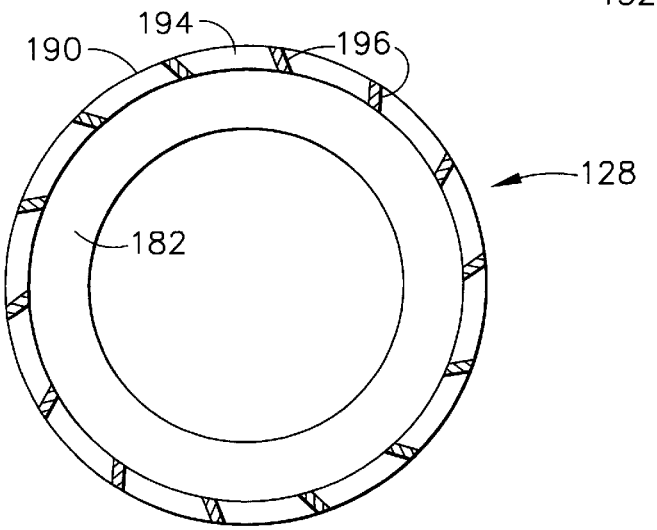
FIG. 6 is a cross-sectional view taken along the line 6—6 of FIG. 4 and showing the orientation of the swirl vanes for providing swirling flow in the secondary combustion zone.

Carried radially outwardly of and opposite from annular housing 168 is annular outer ring 128. A radially-inwardly-extending forward wall 182 of outer ring 128 terminates in an axially-extending collar 184 that is in contact with a lip 186 of fuel nozzle assembly 102 that overlies part of the forward portion of housing 168. An annular outer wall 190 extends between forward wall 182 and a radially-outwardly-extending rear wall 192 that defines a flange. Annular outer wall 190 includes a plurality of substantially rectangular openings 194 that have their major axes disposed in an axial direction, relative to fuel nozzle axis 103, to allow the passage of compressor discharge air through openings 194 and into secondary combustion region 124. The portions 196 of wall 190 between adjacent openings 194 are inclined relative to axis 103 in a radial direction to define swirl vanes for imparting a rotational flow component to the incoming compressor discharge air so that as the air flows through secondary combustion region 124 it travels in a substantially helical path. The arrangement of openings 194 and swirl vanes 196 is shown in cross section in FIG. 6.

Figure 7:
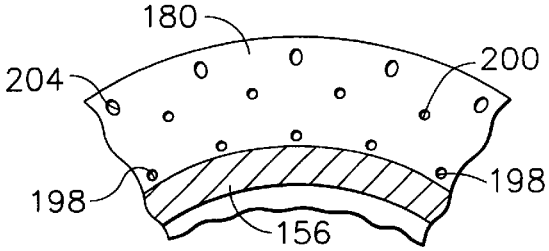
FIG. 7 is a fragmentary cross-sectional view taken along the line 7—7 of FIG. 4*a* and showing the arrangement of cooling air holes in the end wall of the annular housing containing the secondary fuel injectors.

Cooling air enters annular passageway 176 to cool secondary fuel injector 126. The cooling air flows toward and through a plurality of openings that are provided in end wall 180 of annular housing 168. As shown in FIGS. 4, 4*a*, and 7, an inner circular array of axially-extending cooling air apertures 198 is provided in end wall 180, and an intermediate circular array of axially-extending cooling air apertures 200 is provided radially outwardly of the inner circular array. Apertures 198 and 200 can have substantially the same diameter. Preferably, apertures 198 and 200 in the inner and intermediate circular arrays are staggered with respect to each other to provide a substantially uniform flow field within gap 202 to cool flange 158, which is directly exposed to high temperature combustion products.

As best seen in FIG. 4*a*, also provided in end wall 180 and positioned radially outwardly of apertures 200 defining the intermediate circular array is an outermost circular array of apertures 204. Apertures 204 are outwardly and rearwardly inclined relative to fuel nozzle assembly axis 103 to provide a plurality of jets of air that issue in a downstream and in an outward direction. Inclined apertures 204 are so positioned as to cause the air jets that issue therefrom to pass beyond the periphery of flange 158 and toward the innermost portion of secondary combustion region 124. In contrast, axially-extending apertures 198 and 200 are disposed to cause the air jets that issue therefrom to impinge directly on the upstream surface of flange 158. Apertures 204 can be inclined relative to axis 103 of fuel nozzle assembly 102 at an angle of from about 40° to about 50°.

Figure 8:
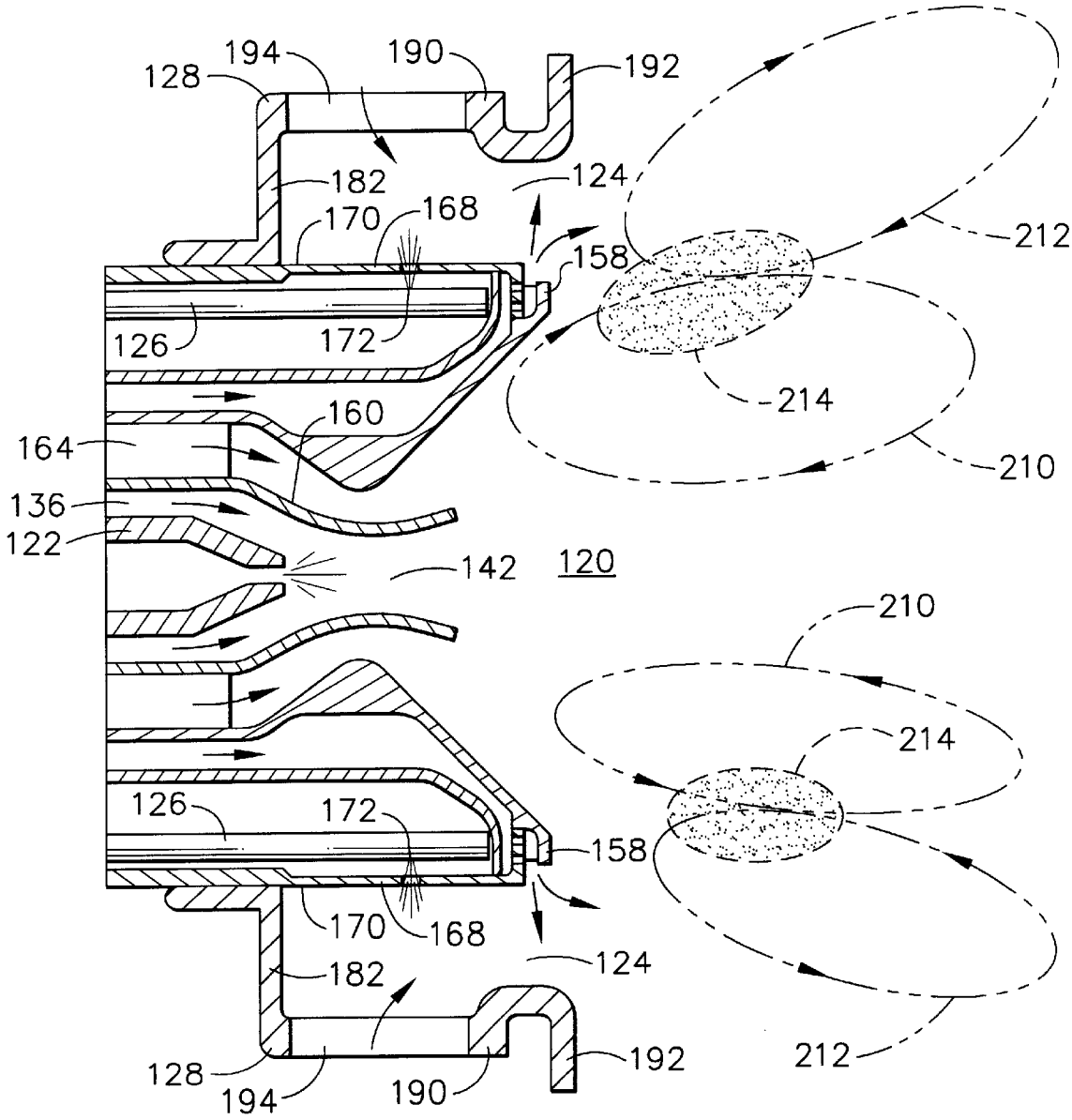
FIG. 8 is a diagrammatic, transverse, cross-sectional view taken through the fuel nozzle and showing the positions of the primary and secondary combustion zones relative to the fuel nozzle assembly.

The mode of operation of the fuel nozzle assembly shown in FIG. 4 is shown in diagrammatic form in FIG. 8. In a first combustion stage, fuel is supplied to primary fuel injector 122 and mixes with swirling air within first diffuser section 142 to provide a combustible fuel-air mixture that expands into and within primary combustion region 120. Surrounding, counter-rotating air that emanates from outer passageway 160 also expands and combines outside of primary annular member 130 to form a swirling, annular, primary recirculation zone 210 within which combustion of the fuel-air mixture continues to take place. The first stage combustion system is utilized under engine idling and low power demand conditions, and the improved mixing and recirculation provided by the disclosed arrangement results in lower HC and CO emissions.

Activation of the second stage of combustion, by injecting fuel from secondary fuel injectors 126 into secondary combustion region 124, occurs when additional output thrust is demanded. The air for combustion within secondary combustion region 124 flows inwardly through openings 194 and is swirled by the inclination of swirl vanes 196 to form a swirling, annular flow pattern within secondary combustion region 124. As the combustion products move axially outwardly beyond flange 192 of annular outer ring 128, they rapidly diffuse and form a secondary recirculation zone 212. The primary and secondary recirculation zones interact and partially intermix in an annular interaction zone 214 that is immediately adjacent and downstream of flange 158 at the downstream end of annular housing 168.

When combustion is taking place within interaction region 214, the outward radial component of the cooling air that issues from the gap between the flange and the end wall of the secondary annular housing helps to reduce the formation of undesirable $NO_x$ emissions by increasing secondary fuel dispersion and promoting additional mixing within the secondary combustion zone. That cooling air flow is the air that issues from apertures 198, 200, and 204 in end wall 180.

When only the first stage of fuel nozzle assembly 102 is in operation, contact between primary recirculation zone 210 and swirling cooling air that enters the combustor through openings 194 in annular outer ring 128 is delayed to thereby improve low power emissions by allowing more complete combustion to occur in the primary combustion zone before cooling of that zone is allowed to occur. The delayed cooling results from the radial separation of the primary and secondary flow streams, and also by virtue of the angular jets that issue from openings 204 that urge the cooling air from region 124, within which combustion is not then taking place, to flow outwardly, allowing combustion within the primary combustion region to proceed to completion.

The inclination of apertures 204 relative to outer wall 170 and relative to end wall 180 provides two benefits. First, a substantially conical air curtain that because of its downstream-directed axial component of velocity causes the boundary layer of air that lies against the outermost surface of outer wall 170 to flow more rapidly, which improves the tolerance to flashback within secondary combustion region 124. Second, the substantially conical air curtain serves to maintain separation of the combustion streams that emanate from primary combustion zone 120 and secondary combustion zone 124, allowing the combustion process within each stream to proceed toward completion with substantial interaction until a point that is further downstream.

Additionally, the angled openings promote secondary atomization, faster droplet evaporation, and better mixing of the fuel and air, and also urges the secondary combustion zone products outwardly and away from the primary combustion zone products to delay intermixing, and therefore the secondary fuel that is entrained within the secondary recirculation zone is delayed from entering the hot primary recirculation zone, thereby diminishing the likelihood of formation of $NO_x$. Those flows coalesce further downstream at a point where the primary combustion zone is at a somewhat lower temperature.

Although particular embodiments of the present invention have been illustrated and described, it will be apparent to those skilled in the art that various changes and modifications can be made without departing from the spirit of the present invention. Accordingly, it is intended to encompass within the appended claims all such changes and modifications that fall within the scope of the present invention.

What is claimed is:

1. A fuel nozzle assembly for a gas turbine engine, said fuel nozzle assembly comprising:

a primary fuel injector having a central axis, wherein the primary fuel injector is disposed for injecting a primary fuel spray into a primary air stream;

a secondary fuel injector positioned radially outwardly of the primary fuel injector for injecting a secondary fuel spray into a secondary air stream that is spaced radially outwardly of and that surrounds the primary air stream; and a primary air jet positioned between the primary fuel injector and the secondary fuel injector, wherein the primary air jet is inclined at a first angle of inclination relative to the primary fuel injector central axis to direct a portion of an incoming air stream between the primary air stream and the secondary air stream in an angular, downstream direction relative to the primary air stream, and a secondary air jet that issues in a direction toward the secondary air stream at a second angle of inclination relative to the primary fuel injector central axis, wherein the second angle of inclination is greater than the first angle of inclination.

2. A fuel nozzle assembly in accordance with claim 1, wherein the primary air jet is defined by a plurality of circularly-disposed air jets that are substantially uniformly distributed around and downstream of the primary fuel injector.

3. A fuel nozzle assembly in accordance with claim 2, wherein the primary air jet defines a substantially continuous annular air curtain between the primary air stream and the secondary air stream and has a velocity component aligned with the primary fuel injector central axis and a velocity component that is perpendicular to the primary fuel injector central axis.

4. A fuel injector in accordance with claim 3, wherein the inclination of the primary air jet is between about 40° and about 50° relative to the primary fuel injector central axis.

5. A fuel nozzle assembly in accordance with claim 1, wherein the primary and secondary air streams each include a tangential velocity component to provide swirling primary and secondary air streams.

6. A fuel nozzle assembly in accordance with claim 5, wherein the primary and secondary air streams swirl in the same direction relative to the primary fuel injector central axis.

7. A fuel nozzle assembly in accordance with claim 1, wherein the secondary air jet issues toward the secondary air stream in a substantially radial direction relative to the primary fuel injector central axis.

8. A fuel nozzle assembly in accordance with claim 1, wherein the secondary air jet initially issues from an annular cooling air passageway in a substantially axial direction relative to the primary fuel injector central axis and impinges against a substantially radially-extending flange that deflects the secondary air jet from a substantially axial initial direction to a substantially radial direction.

9. A fuel nozzle assembly for a gas turbine engine combustor for staged combustion, said nozzle assembly comprising:

a primary fuel injector having a surrounding annular passageway that includes a plurality of circumferentially-disposed swirl vanes to provide a surrounding primary coaxial swirl region of incoming primary combustion air about a fuel spray emanating from the primary fuel injector for improved fuel-air mixing in a primary combustion region;

an annular ring coaxial with the primary fuel injector and spaced radially outwardly therefrom to define a secondary combustion region, the ring having a plurality of circumferentially-spaced, elongated, axially-extending openings to provide a secondary coaxial swirl region of incoming secondary combustion air that swirls radially outwardly of the primary coaxial swirl region; and an annular housing positioned between the annular ring and the primary fuel injector, the annular housing enclosing a plurality of circularly-disposed secondary fuel injectors and including an end wall that faces in a downstream direction and an annular outer wall having a plurality of radial openings to allow fuel to issue from the secondary fuel injectors into the secondary swirl region, the housing including an annular inner wall spaced inwardly of and coaxial with the outer wall, the inner wall flaring outwardly to define an outer diffuser region downstream of the primary fuel injector and terminating in a radially-outwardly-extending flange spaced axially downstream of the end wall to define a gap therebetween, and a plurality of circularly-disposed, spaced, cooling air apertures in the end wall to allow passage therethrough of cooling air for cooling the outwardly extending flange.

10. A fuel nozzle assembly in accordance with claim 9, wherein the primary fuel injector is oriented to spray fuel in an axial direction.

11. A fuel nozzle assembly in accordance with claim 9, wherein the secondary fuel injectors are oriented to spray fuel in a substantially radial direction.

12. A fuel nozzle assembly in accordance with claim 10, wherein the secondary fuel injectors are oriented to spray fuel in a substantially radial direction.

13. A fuel nozzle assembly in accordance with claim 9, wherein the end wall includes a single circularly-disposed array of cooling air apertures.

14. A fuel nozzle assembly in accordance with claim 9, wherein the end wall includes an outer, circularly-disposed array of cooling air apertures and an inner, circularly-disposed array of cooling air apertures.

15. A fuel nozzle assembly in accordance with claim 11, wherein the outer and inner arrays of cooling air apertures are offset from each other in a circular direction to provide a substantially uniform flow field.

16. A fuel nozzle assembly in accordance with claim 9, including an outermost circular array of cooling air apertures disposed to issue air jets that flow in an inclined downstream and outward direction relative to the fuel assembly axis.

17. A fuel nozzle assembly in accordance with claim 16, including an inner circular array of cooling air apertures disposed to issue air jets that flow in an axial direction to impinge upon and to cool the flange.

18. A fuel nozzle in accordance with claim 17, wherein the air jets from the outermost array of cooling air apertures pass outwardly of the flange to define a curtain of air to separate a primary combustion region from a secondary combustion region.

19. A fuel nozzle assembly in accordance with claim 18, wherein the angle of inclination of the outermost array of cooling air apertures is between about 40° and about 50°.

* * * * *